United States Patent [19]

Nagano

[11] Patent Number: 4,663,566

[45] Date of Patent: May 5, 1987

[54] FLUORESCENT TUBE IGNITOR

[75] Inventor: Fumikazu Nagano, Yamatokoriyama, Japan

[73] Assignee: Sharp Kabushiki Kaisha, Osaka, Japan

[21] Appl. No.: 697,389

[22] Filed: Feb. 1, 1985

[30] Foreign Application Priority Data

Feb. 3, 1984 [JP] Japan ..... 59-18535

[51] Int. Cl.[4] ..... H05B 39/00

[52] U.S. Cl. ..... 315/97; 315/98; 315/105; 315/161; 315/DIG. 5

[58] Field of Search ..... 315/105, 270, 271, 98, 315/99, 277, 278, 325, 252, 251, 95, 97, 161, DIG. 5

[56] References Cited

U.S. PATENT DOCUMENTS

| | | | |
|---|---|---|---|
| Re. 31,146 | 2/1983 | Gyursanszky | 315/106 |
| 2,504,549 | 4/1950 | Lemmers | 315/97 |
| 2,849,656 | 8/1958 | Karash | 315/99 |
| 3,141,112 | 7/1964 | Eppert | 315/277 |
| 3,304,464 | 2/1967 | Feinberg | 315/98 |
| 3,305,697 | 2/1967 | Neusbaum | 315/98 |
| 3,418,527 | 12/1968 | Miller | 315/98 |
| 3,463,964 | 8/1969 | Privett et al. | 315/97 |
| 3,754,160 | 8/1973 | Jensen | 315/97 |
| 4,004,184 | 1/1977 | Ott | 315/101 |
| 4,158,793 | 6/1979 | Lewis | 315/DIG. 5 |
| 4,189,663 | 2/1980 | Schmutzer | 315/DIG. 5 |
| 4,277,726 | 7/1981 | Burke | 315/98 |

*Primary Examiner*—Harold Dixon

*Attorney, Agent, or Firm*—Birch, Stewart, Kolasch & Birch

[57] ABSTRACT

The preferred embodiment provides such a fluorescent tube ignitor having a plurality of auxiliary electrodes provided in the periphery of the tube wall of each fluorescent tube, while the potentials of these auxiliary electrodes are set at a specific level equal to or lower than those of the low-voltage-applied filament circuits of each fluorescent tube. Integration and simplification of the preheat circuit at one-end of respective fluorescent tubes securely realizes a still smaller size of the ignitor, cost reduction, suppression of noise interference, and easier and faster start of illumination.

11 Claims, 4 Drawing Figures

FIG. 2
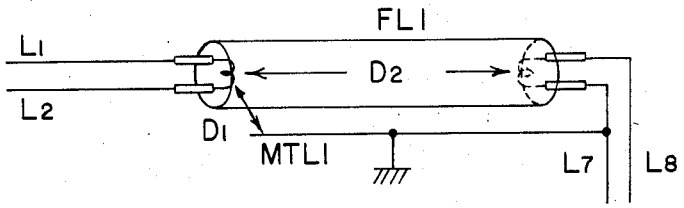
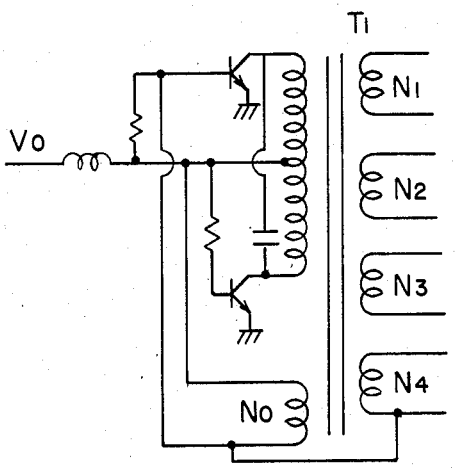
FIG. 3
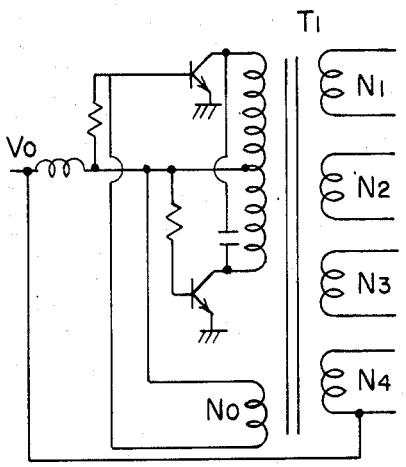
FIG. 4

FLUORESCENT TUBE IGNITOR

BACKGROUND OF THE INVENTION

The present invention relates to a fluorescent tube ignitor that drives a plurality of fluorescent tubes to light up simultaneously in a variety of electronic equipment including facsimiles, color scanners, optical character readers (OCR), and others.

Conventionally, existing fluorescent tube ignitors provide each fluorescent tube with an independent driving circuit. A plurality of fluorescent tubes constitute a complete unit. Such a conventional configuration obliges each fluorescent tube ignitor unit to contain a plurality of driving circuits, the number of circuits corresponds to the number of fluorescent tubes provided in the unit. As a result, these circuits have actually occupied a substantial area in each complete unit, and thus, they make it difficult to realize small sized modern electronic equipment using fluorescent tubes.

OBJECT AND SUMMARY OF THE INVENTION

The present invention aims at realizing a compact fluorescent tube ignitor by simplifying and integrating part of the preheating circuits of a plurality of fluorescent tubes, thus reducing the cost, suppressing the noise interference, and providing easy access to the quick illumination of fluorescent tubes in such electronic equipment. The fluorescent tube ignitor incorporating the preferred embodiment of the present invention provides such a unique configuration, in which auxiliary electrodes are provided in the periphery of each of a plurality of fluorescent tubes, filaments at one-end of each fluorescent tube are connected in parallel with one another to the terminals first output voltage of a preheat circuit, while each of the filaments at the other end of the fluorescent tubes are connected to separate outputs of the high-voltage supply unit at a first terminal and also each filament is connected to an independent second output voltage of the preheat circuit at said first terminal and a second terminal of the filament.

As described above, the fluorescent tube ignitor embodied in the present invention provides auxiliary electrodes in the periphery of the tube wall of each fluorescent tube and sets the potential of the auxiliary electrodes to be equal to or lower than the potential of the low-voltage-applied filament circuit of each fluorescent tube. As a result, when a plurality of fluorescent tubes light up simultaneously, discharge can be started easily. In addition, since the low-voltage-applied filament circuit of each fluorescent tube is integrally connected in parallel to a power-supply terminal the entire circuit configuration has been significantly simplified, thus providing easy access to the wiring operation, and yet, the circuit configuration embodied by the present invention is ideally suited to realizing a still further compact size of the entire unit and reducing cost as well. In particular, due to the sharply-reduced dimensions of the high-voltage-applied filament circuit, noise interference from the fluorescent tube circuit can effectively be eliminated, and as a result, such advantageous features can be ideally applied to the fluorescent tube circuits incorporated in facsimiles, optical character readers, or color scanners dealing with different colors including red, green and blue.

BRIEF DESCRIPTION OF THE DRAWINGS

FIG. 2 is a simplified configuration of a fluorescent tube ignitor when actually being operated; and FIGS. 3 and 4 are respectively still further preferred embodiments of the present invention.

DETAILED DESCRIPTION OF THE PREFERRED EMBODIMENTS

Figure 1:
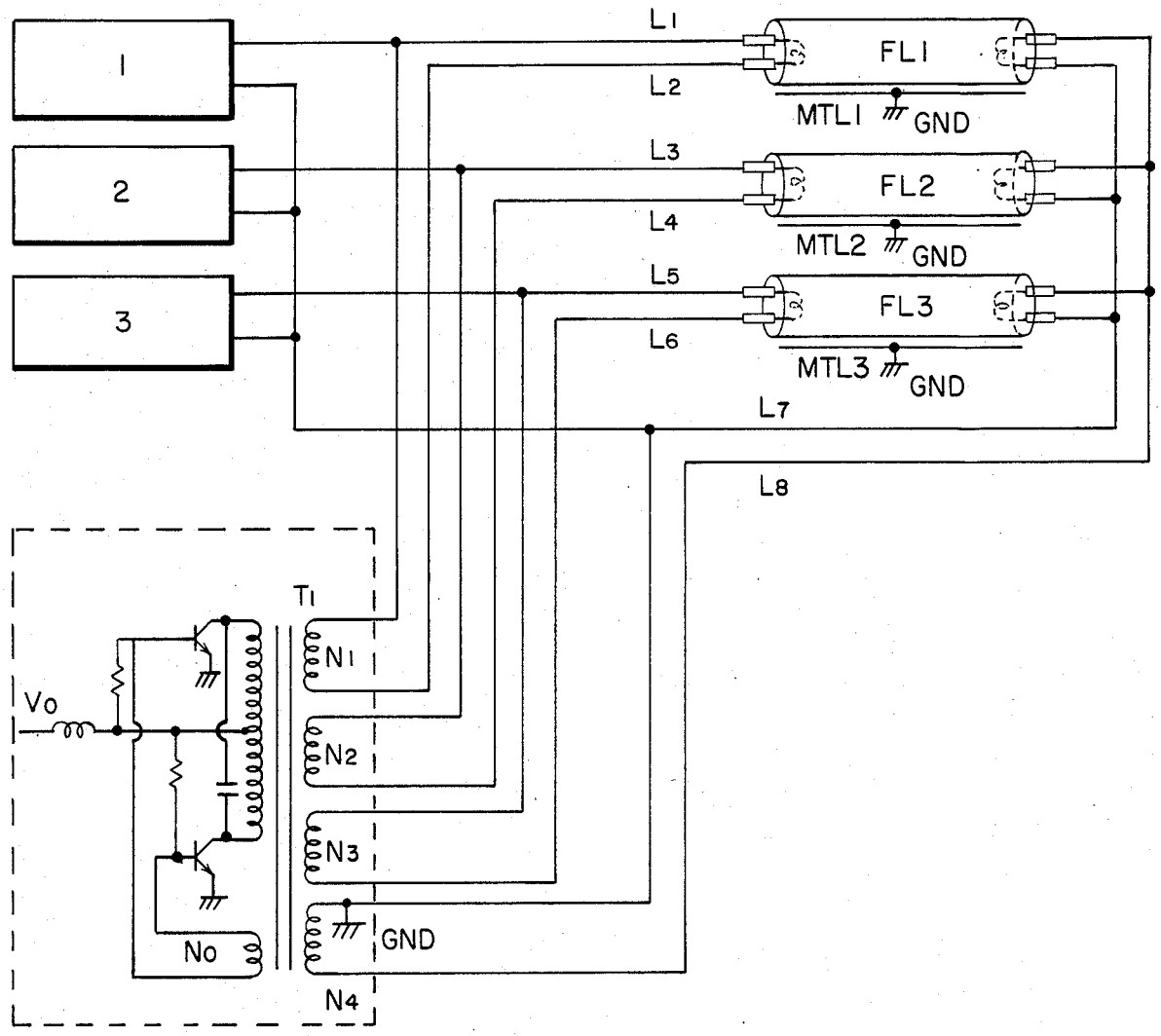
FIG. 1 is a simplified block diagram of a fluorescent tube ingnitor circuit incorporating the preferred embodiment of the present invention.

Referring now to the attached drawings, the preferred embodiments of the present invention are described below. FIG. 1 shows one of the preferred embodiments denoting the wiring diagram between the fluorescent tube and the filament preheating circuit. As is clear from the drawing, each terminal of the secondary coils N1 through N3, being the second output voltage terminals of the power transformer T1 that makes up the filament preheating circuit, is respectively connected to the high-voltage-applied filament circuits L1 through L6 that are provided for three filament tubes FL1 through FL3. The secondary coil N4 which is the first output voltage terminal of the power transformer $T_1$ is connected in parallel to the other low-voltage-applied filament circuit of each fluorescent tube, with one of the terminal of the secondary coil N4 being grounded. In addition, auxiliary electrodes MTL1 through MTL3 are respectively grounded and are positioned close to the external circumference of each fluorescent tube. A specific low voltage Vo, for example +24 VDC, is applied to the primary coil of the power transformer T1, whereas each terminal of the secondary coils N1 through N3 outputs a specific low voltage containing a high frequency, for example a signal having a 7 VDC component and a frequency of 20 KHz for delivery to the preheating circuit. The high-voltage-applied filament circuits L1 through L6 respectively receive a specific high-voltage from each of the ignitors 1 through 3 that supply high voltages during illumination. Taking this into account, the wiring length of these filament circuits L1 through L6 has been designed to be shorter than those which are provided for the low-voltage-applied filament circuits L7 and L8, thus eventually making it possible to securely suppress noise interference from the inner components of the unit. In the circuit configuration described above, the terminal of one-end of the secondary coil N4 is grounded. In other preferred embodiments illustrated in FIGS. 3 and 4, the terminal of the secondary coil N4 is connected to the input of the power transformer T1 to obtain a potential equivalent to the low-voltage Vo fed to the primary coil so that it can also be connected to the low-voltage-applied filament circuits L7 and L8. One of the preferred embodiments, shown in FIG. 3, connects the terminal of the second coil N4 to the primary coil No to cause the potential of the secondary coil N4 to become equal to that of the primary coil No, and as a result, the potential of the secondary coil N4 approximates the input voltage Vo. One of the preferred embodiments shown in FIG. 4 is very close to the preferred embodiment shown in FIG. 3. By connecting the terminal of the secondary coil N4 to the input terminal of the power transformer T1, the potential of the secondary coil N4 becomes equal to that of the input voltage Vo. As shown above, by causing the potential of the low-voltage-applied filament circuits L7 and L8 of the fluorescent tube to become equal to that of the input voltage Vo or by holding these potentials close to this voltage Vo, the fluorescent tube can be lit very easily.

Taking the fluorescent tube FL1 shown in FIG. 2 for example, one of the preferred embodiments is described, in which, auxiliary electrodes MTL1 through MTL3 are respectively connected to ground and are close to the tube walls of the fluorescent tubes FL1 through FL3 so that the potentials of these can become equal to that of the low-voltage-applied filament circuits. In this case, the ignitor 1 feeds a high voltage V1 to the high-voltage-applied filament circuits L1 and L2 of the fluorescent tube FL1, whereas the low-voltage-applied filament circuits L7 and L8 respectively receive a low voltage from the secondary coil N4 of the power transformer T1. When this condition exists, connection of the auxiliary electrode MTL1 to the ground terminal has the same effect as the case in which the potential of the auxiliary electrode MTL1 is equal to those of the low-voltage-applied filament circuits L7 and L8. As a result, as is clear from the electric field intensity between the high-voltage-applied filament circuits L1/L2 and the auxiliary electrode MTL1, when the auxiliary electrode MTL1 doesn't match the potential of of the low-voltage power source, the electric field intensity is denoted by V1/D2, where V1 is the filament voltage relative to the distance D2 between the filament circuits L1 and L2, and tis electric field causes discharge to start immediately. When the potentials of the auxiliary electrode MTL1 and the low-voltage power source are equal to each other, the electric field intensity V1/D1 (where D1 denotes the shortest distance between the auxiliary electrode MTL1 and the high-voltage-applied filament circuits) functions to allow discharge to start. Now, these electric field intensities are compared. Since the distance D2 is greater than D1, the electric field intensity V1/D1 is greater than V1/D2. This clearly indicates the fact that, since the greater electric field functions when the auxiliary electrode MTL1 is connected to the ground, discharge can be activated very easily. In conjunction with this, as shown in FIGS. 3 and 4, by causing the secondary coil N4 to bear such a potential equal to or close to the input voltage Vo, as in the above case, the electric field intensity between the filaments of the high-voltage-applied filament circuits L1 through L6 and the auxiliary electrodes MTL1 through MTL3 becomes greater than that functioning between filaments on both sides, and as a result, discharge can be started very easily.

What is claimed is:

1. An ignitor circuit for igniting a plurality of fluorescent tubes, each tube having external walls, a first and a second end and first and second filaments, each disposed within said tube adjacent the first and second end respectively, comprising:

a first plurality of filament electrodes connected to the first filament of each tube and a second plurality of filament electrodes connected to the second filament; said second plurality of filaments being connected in parallel;

preheater means for pre-heating the filaments of each tube, said preheater including first low voltage means for providing a plurality of first low voltage sources connected individually to each of said first plurality of filament electrodes at the first end of each tube, said preheater means further including second low voltage means for providing a single second low voltage to said parallel connected second plurality of filament electrodes at the second end of each tube;

a plurality of high voltage ignites for supplying a specific high voltage individually to the filaments of each tube to selectively illuminate each tube, said high voltage means having a plurality of separate high voltage lines, each high voltage line connected separately to a first electrode of said first plurality of filament electrodes at the first end of a corresponding tube, said igniter means having a plurality of ground lines, each ground line connected to a first electrode of said second plurality of filament electrodes at the second end of a corresponding tube; and a plurality of auxiliary electrodes, each auxiliary electrode disposed in proximity to the external walls of a corresponding tube and extending the length of the tube between the first and second end, each said auxiliary electrode having an electric potential approximately equal to said first electrode of said second plurality of filament electrodes of said corresponding tube and means for providing an ionization voltage in common to said second filaments.

2. The ignitor circuit of claim 1 wherein said second low voltage means includes a second low voltage line connected to a second electrode of said second plurality of electrodes of each tube and a second ground line commonly connected to said first electrode of said second plurality of filament electrodes of each tube and to said plurality of ground lines of said high voltage means.

3. The ignitor circuit of claim 2 wherein said preheater means includes; A preheater input voltage means for receiving a preheat voltage, and a power transformer, including a plurality of primary coils and plurality of secondary coils, for transforming said preheat voltage into said first and second low voltages.

4. The ignitor of claim 3 wherein said second low voltage means further includes a first secondary coil of said plurality of secondary coils, said first secondary coil being connected to said second low voltage line and said second ground line, producing said second low voltage in accordance with a voltage at a first primary coil of said plurality of primary coils.

5. The ignitor circuit of claim 4 wherein said second low voltage line is also connected to said first primary coil.

6. The ignitor circuit of claim 4 wherein said second low voltage line is also connected to said pre-heater voltage input means.

7. The ignitor circuit of claim 4 in which the number of tubes equals n and the number of secondary coils equals $n+1$.

8. The ignitor circuit of claim 7 in which n of the secondary coils have a one to one correspondence with each tube, said n secondary coils developing said first low voltage that is applied to said first plurality of filament electrodes at the first end of each tube.

9. The ignitor circuit of claim 7 wherein $n=3$.

10. The ignitor circuit of claim 4 wherein the number of flourescent tubes is equal to 3.

11. The ignitor circuit of claim 9 wherein each said auxiliary electrode is disposed external to a corresponding fluorescent tube.

* * * * *